US005404599A

United States Patent [19]

Warkus et al.

[11] Patent Number: 5,404,599

[45] Date of Patent: Apr. 11, 1995

[54] ATTACHMENT PLATE ON A SUPPORTING FRAME

[75] Inventors: Clemens Warkus, Wald; Thomas Vogel, Pfullendorf, both of Germany

[73] Assignee: Geberit AG, Jona, Switzerland

[21] Appl. No.: 86,251

[22] Filed: Jul. 1, 1993

[30] Foreign Application Priority Data

Jul. 16, 1992 [CH] Switzerland ..... 2245/92

[51] Int. Cl.[6] ..... E03D 11/14

[52] U.S. Cl. ..... 4/670; 4/695; 4/252.1; 4/252.2; 248/222.3; 248/689

[58] Field of Search ..... 4/670, 695, 696, 252.1, 4/252.3, 252.2, 643, 647, 648; 248/68.1, 911, 912, 222.3, 689; 403/396, 397, 350, 351

[56] References Cited

U.S. PATENT DOCUMENTS

| | | | |
|---|---|---|---|
| 1,930,314 | 10/1933 | Healy et al. | 4/648 |
| 2,375,513 | 5/1945 | Bach | 248/68.1 |
| 2,702,732 | 2/1955 | McCarran | 4/643 |
| 2,903,712 | 9/1959 | Morris . | |
| 3,020,565 | 2/1962 | Manas et al. | 4/252.3 |
| 3,129,751 | 4/1964 | Weber | 248/222.3 |
| 3,235,219 | 2/1966 | Green | 248/222.3 |
| 3,347,505 | 10/1967 | Menser | 248/68.1 |
| 3,606,217 | 9/1971 | Leiferman | 248/68.1 |
| 4,101,233 | 7/1978 | McConnell | 403/397 |
| 4,358,216 | 11/1982 | Pleickhardt et al. | 403/397 |
| 4,591,287 | 5/1986 | Hughes . | |
| 4,693,383 | 9/1987 | Fenwick | 403/397 |
| 4,703,593 | 11/1987 | Smolik . | |
| 4,951,827 | 8/1990 | Moransais | 248/222.3 |
| 5,242,241 | 9/1993 | Nelson | 403/396 |

FOREIGN PATENT DOCUMENTS

| | | | |
|---|---|---|---|
| 2057525 | 6/1992 | Canada | 4/670 |
| 0404726 | 12/1990 | European Pat. Off. . | |
| 0407351 | 1/1991 | European Pat. Off. . | |
| 2334865 | 7/1977 | France . | |
| 3309460 | 9/1984 | Germany . | |
| 9005168 U | 9/1990 | Germany . | |
| 2148378 | 5/1985 | United Kingdom | 403/350 |

*Primary Examiner*—Henry J. Recla
*Assistant Examiner*—Charles R. Eloshway
*Attorney, Agent, or Firm*—Bucknam and Archer

[57] ABSTRACT

The attachment plate has laterally several openings (4) which each extend along an edge (9) and around it. The openings (4) serve in each instance the purpose of inserting a rotary snap-in connector (15) which has a handle (17) and a head (16) formed on it. The head (16) is so shaped as to correspond to a dovetail groove (11) of a profile rod (10) and is snapped into it. A snapping lug (7) engages form-fittingly with a channel (12) of a contour of the rods (10). The rotary snap-in connectors (15) can be set in without tools, are latchable and permit an independent mounting of the attachment plate (1) on a supporting frame having profile rods (10).

5 Claims, 2 Drawing Sheets

ATTACHMENT PLATE ON A SUPPORTING FRAME

The present invention relates to an attachment plate on a supporting frame, in particular for mounting sanitary connection lines with means which detachably connect the attachment plate with the profile rods of the supporting frame.

BACKGROUND OF THE INVENTION

A fixture plate is known which is mounted by means of screws on rectangular tubes of a supporting frame and which has several openings disposed at a given distance one from the other and which are provided for mounting fixtures and their connection lines, in particular for the hot and cold water connection. With an attachment plate of this type of a supporting frame a comparatively simple mounting of fixtures fronting the wall is possible. However mounting the fixture plate on the supporting frame is comparatively expensive in labor.

SUMMARY OF THE INVENTION

An object of the present invention is to provide an attachment plate of the stated type which may be mounted significantly more easily and which nevertheless meets sanitary requirements.

This object is achieved by providing the stated means as rotary snap-in connectors which go through a lateral recess of the attachment plate and snap into a longitudinal groove of a profile rod. Through the snapping of the rotary snap-in connector into a longitudinal groove of a profile rod a form-fit connection between the rotary snap-in connector and the profile rod may be obtained which effectively prevents a displacement of the rotary snap-in connectors along the profile rod. In view of the fact that since the rotary snap-in connectors may be set in and snapped in at any site in the longitudinal groove, a stepless mounting of the attachment plate on the supporting frame is possible. The adjustment and alignment of the attachment plate consequently is significantly simpler than according to the known attachment plate. For mounting the attachment plate on the supporting frame no tools are required, a fact which significantly simplifies the mounting step.

It has also been found that these rotary snap-in connectors can be produced very cost-effectively and yet are durable and robust in the form of injection molded parts made of synthetic material. They may also be fabricated in diecasting processes.

Another advantage is that few individual parts are required so that, lastly, an attachment plate on a supporting frame is provided which evidently is made with relatively few simple structural parts, and which meets not only the technical sanitary requirements extremely well but which, due to its simple implementation, is moreover favorable in terms of cost and is reliable.

BRIEF DESCRIPTION OF THE DRAWINGS

Further advantageous features are described in the following specification, the dependent claims as well as the drawings. An example of the invention will be explained in greater detail in conjunction with the drawings of which:

DESCRIPTION OF THE PREFERRED EMBODIMENT

Figure 2:
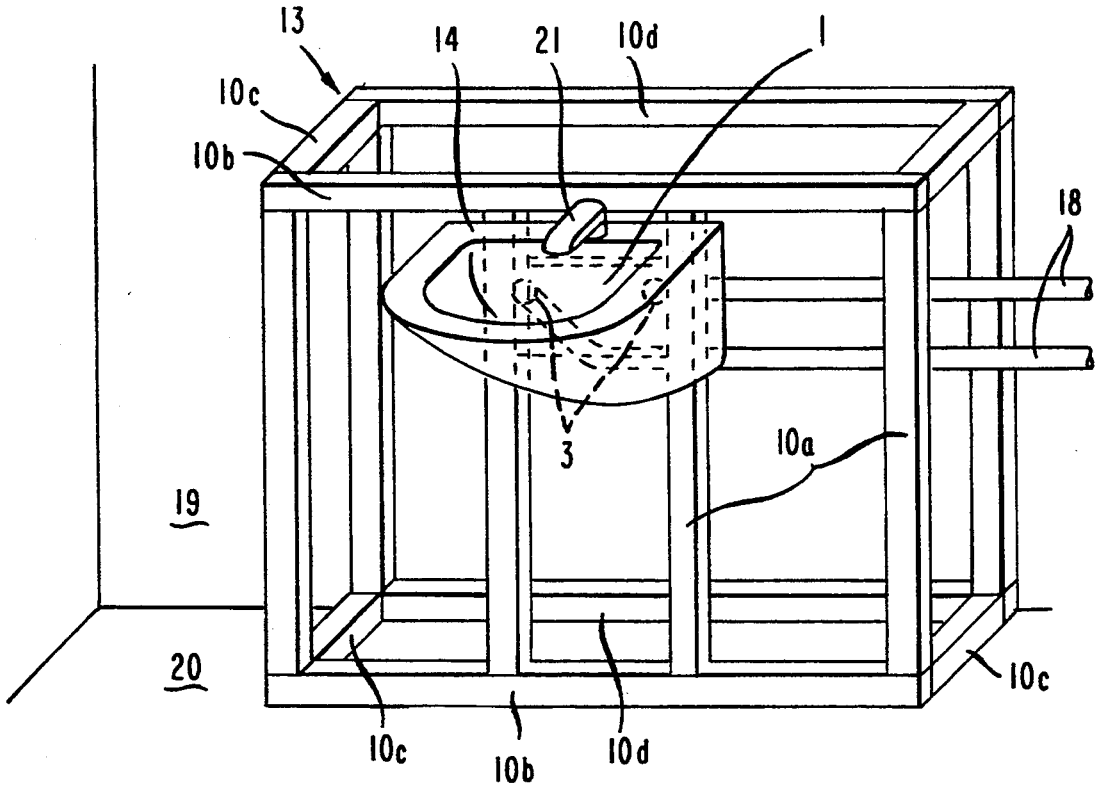
FIG. 2 is a schematic perspective partial view of an attachment plate on a supporting frame with sanitary objects mounted thereon.
Figure 3:
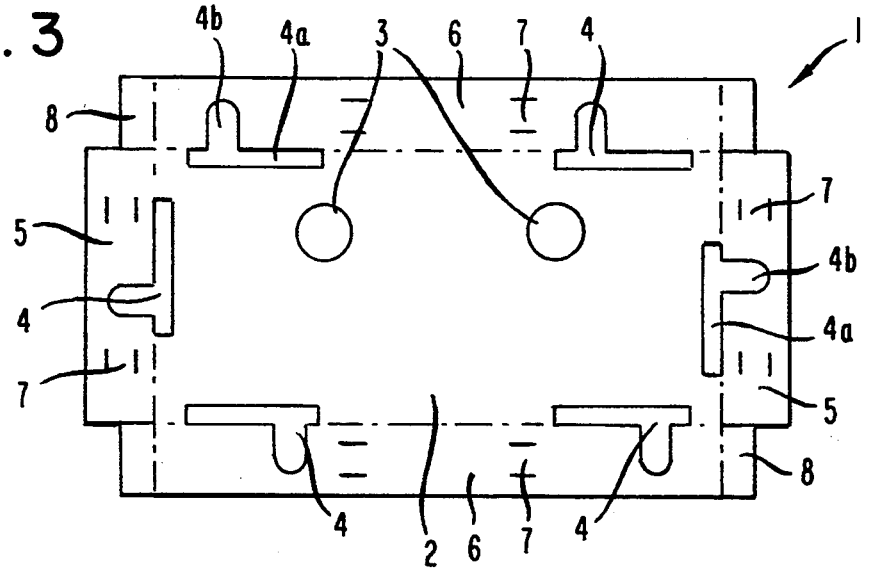
FIG. 3 illustrates an attachment plate.

FIG. 2 shows schematically a supporting frame 13 which has a three-dimensional structure and which is mounted on a housing wall 19 and floor 20. An attachment plate 1 made of sheet metal with connection openings 3 is mounted on vertical profile rods 10*a* and a horizontal profile rod 10*b*. Transverse profile rods 10*c* of the stated profile rods are connected with further profile rods 10*d* disposed in parallel behind them.

To the attachment plate 1 are mounted water connection lines 18 for a water fixture 21 on a washstand 14. The washstand 14 is mounted with bolts, not shown here, in known manner on profile rods 10*a*. The water connection lines 18 are fastened in known manner to openings 3 of the attachment plate 1, and water pipes 18 are connected with the fixture 21 through the opening 3. As can be seen, the front face of the attachment plate 1 is flush with the front face of the profile rods 10*a* and 10*b*.

Figure 1:
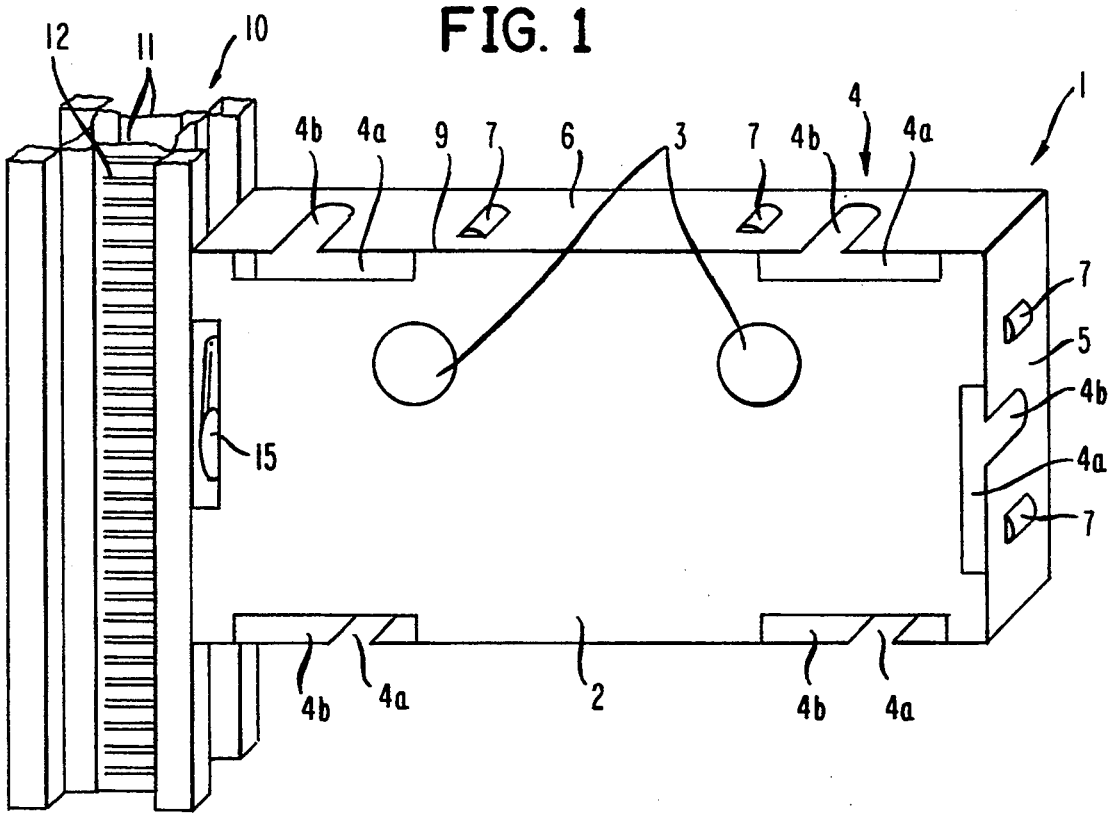
FIG. 1 is a perspective partial view of an attachment plate on a supporting frame according to the invention.

As shown in FIG. 1, the attachment plate 1 is implemented so as to be box-form and has a planar rectangular front face 2 as well as side portions 5 and 6 at a right angle. The front face has the above stated connection openings 3 which, as shown, may be circular. For mounting the attachment plate 1 on profile rods 10 the attachment plate 1 has several openings 4 which extend along the bent edges 9 and around them. These openings 4 comprise in each instance a slot 4*a* disposed at the front face for inserting a rotary snap-in connector 15. The slot 4*a* is connected in each instance with a slot 4*b* extending transversely to it, and which extends in a side portion 5 or 6 and through which the head 16 of a rotary snap-in connector 15 can be set into a groove 11 of a profile rod 10. The attachment plate 1 shown here comprises at the side portions 6 two openings 4 each and at the shorter side portions 5 one opening 4 each. The attachment plate 1 consequently can be connected on all sides with a profile rod 10. However it is also possible to connect the attachment plate 1 only on two side portions 5 or 6, respectively, with profile rods 10.

The profile rods 10 are hollow rectangular tubes and have on each side a dovetail groove 11 extending in the longitudinal direction. The groove bottoms of the profile rods 10 are contoured in each instance by means of transversely extending channels 12. The function of these channels 12 will be explained hereinbelow in greater detail in conjunction with FIGS. 4 to 7.

Figure 4:
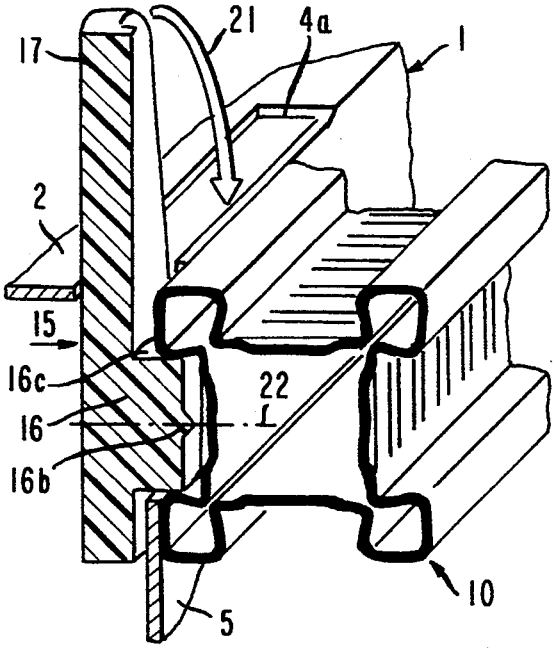
FIGS. 4 and 5 are perspective views of a portion of an attachment plate on a supporting frame.
Figure 5:
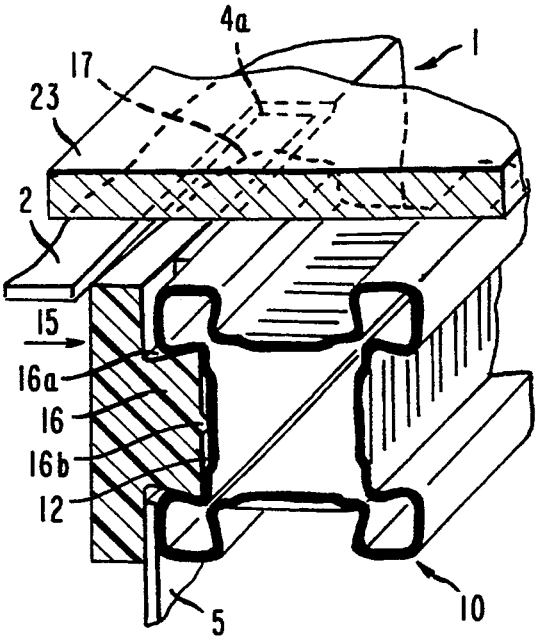
Figure 6:
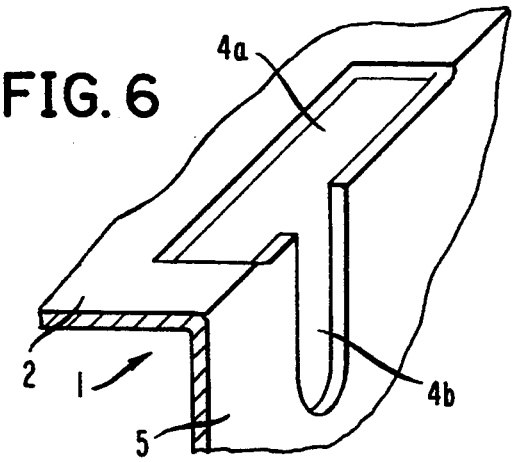
FIG. 6 is a perspective partial view of an attachment plate.
Figure 7:
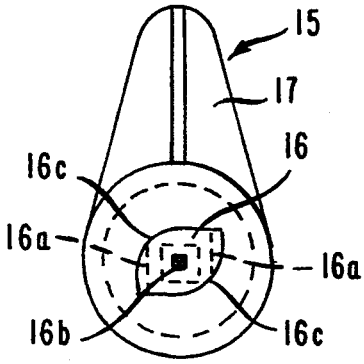
FIG. 7 is a view of a rotary snap-in connector.

The rotary snap-in connector 15 shown in these Figures is made integrally of a suitable synthetic material as an injection molded part and has a lobe-form handle 17 onto which is formed a laterally projecting head 16. This head 16 is implemented so as to correspond to the grooves 11 and has laterally opposing undercuts 16*a* and on the front face a projecting bump 16*b*. The undercuts 16*a* change over opposingly into bent guide surfaces 16*c*. The distance of opposing guide surfaces 16*c* is equal to or smaller than the smallest width of a dovetail groove 11. In order to connect an attachment plate 1 with a profile rod 10, a side portion 5 or 6 is placed with its surface on a profile rod 10 and as shown in FIG. 4, the front face 2 is flush with one side of the profile rod 10. Through a slot 4*a* of an opening 4 or from the rear side of the plate 1 a rotary snap-in connector 15 is inserted into the attachment plate 1 and the head 16 through the slot 4*b* into a groove 11. As shown in FIG. 4, handle 17 then projects at the front face on the attachment plate 1. When the rotary snap-in connector 15 is rotated by its handle by 90° in the direction of the arrow 21, the rotary snap-in connector 15 rotates about a swivelling axis 22 extending through the bumps 16*b*. Through this swivel motion the handle 17 is lowered by the slot 4*a* behind the front face 2 and the head 16 is clamped in a dovetail groove 11 through the laterally adjoining undercuts 16*a* and through the bump 16*b* engaging a channel 12 and snaps in. The snap-in connection is consequently closable from the front. The laterally adjacent undercuts 16*a* prevent a motion of the rotary snap-in connectors 15 transversely to the profile rod 10 and the bumps 16*b* prevent a motion of the rotary snap-in connector 15 in the longitudinal direction of the profile rod 10. The snapped-in position of the rotary snap-in connector 15 is shown in FIG. 5. Longitudinal displacement of the attachment plate 1 is the longitudinal direction of the profile rod 10 is also impossible since the side portion 5 on the slot 4*b* is bilaterally adjacent on the head 16 and, moreover, the surface of the side portion 5 is clamped between the handle 17 and the profile rod 10. The attachment plate 1 is consequently in both longitudinal directions of the profile rod 10 and in one transverse direction form-fit and force-fit to the profile rod 10.

It is evident that the rotary snap-in connector 15 can be inserted into the opening 4 without tools and can be snapped into the groove 11. It is just as simple to detach again the rotary snap-in connector 15, for example for adjustments.

A planking plate 23 shown in FIG. 5 applied subsequently prevents an unwanted swivelling of the connector 15 and consequently prevents detachment of the snap-in connection.

As shown in FIG. 1, the side portions 5 and 6 have each two projecting lugs 7 which engage a groove 11 of a profile rod 10 placed against them and these lugs 7 are essentially as wide as a groove 11. Therefore it is ensured that an attachment plate 1 mounted on a supporting frame 13 at its front face is flush with the adjacent profile rods 10. However, the attachment plate 1 is not only flush at the front face but rather also has no projecting parts which would hinder mounting a fixture or a sanitary object. The lugs 7, in addition, secure the attachment plate 1 against twisting and this explains the fact that, as a rule, in each instance one rotary snap-in connector 15 on one plate side is sufficient.

As a rule, the attachment plate 1 shown in FIG. 1 is mounted on both side portions 5. The plate can simultaneously also be mounted on horizontal profile rods 10. It is understood that it is also possible to mount the plate 1 rotated by 90° on a supporting frame 13.

What is claimed is:

1. A device for mounting sanitary connection lines which comprises an attachment plate (1), a frame (13) supporting said attachment plate, means (15) for detachably connecting said attachment plate (1) to said frame, said frame having profile rods (10), said means (15) being rotary snap-in connectors, each of said profile rods (10) having a groove (11),said attachment plate having lateral recesses (4), and having a rectangular front face (2) a rear open side, and side portions (5) and (6), said recesses (4) consisting essentially of a first slot (4*a*) and a second slot (4*b*), said first slot being disposed on said front face and said second slot (4*b*) extending transversely with respect to said first slot, said second slot being located in one of said side portions (5) and (6) and being connected to said first slot, each of said snap-in connectors has a handle (17), said handle being rotatable through said slot (4*a*), said snap-in connectors (15) being inserted from said open rear side, to project from said front face, each of said snap-in connectors (15) after having been introduced into said first slot (4*a*) from said open rear side of said attachment plate snapping into each of said grooves (11).

2. A device for mounting sanitary connection lines which comprises an attachment plate (1), a frame (13) supporting said attachment plate, means (15) for detachably connecting said attachment plate (1) to said frame, said frame having profile rods (10), said means (15) being rotary snap-in connectors, said attachment plate having lateral recesses (4), each of said profile rods (10) having a groove (11), each of said rotary snap-in connectors snapping into said grooves (11) after having been introduced into said lateral recesses, wherein said attachment plate has a front face (2) and side portions (5,6) connected thereto at right angles and rearwardly bent said recesses (4) consisting essentially of a first slot (4*a*) and a second slot (4*b*), said first slot being located on said front face (2), said second slot (4*b*) being located on one of said side portions, said rotary snap-in connectors having a head (16), said head being inserted through said second slot, said side portions (5,6) having projecting lugs (7), said lugs being inserted into said grooves (11) of said profile rods (10) for centering and for load transfer of said attachment plate (1).

3. A device for mounting sanitary connection lines which comprises an attachment plate (1), a frame (13) supporting said attachment plate, means (15) for detachably connecting said attachment plate (1) to said frame, said frame having profile rods (10), said means (15) being rotary snap-in connectors, said attachment plate having lateral recesses (4), each of said profile rods (10) having a groove (11), each of said rotary snap-in connectors snapping into said grooves (11) after having been introduced into said lateral recesses, wherein said attachment plate has side portions (5,6) connected thereto at right angles and rearwardly bent, said recesses (4) consisting essentially of a first slot (4*a*) and a second slot (4*b*), said first slot being located on said front face (2), said second slot (4*b*) being located on one of said side portions, wherein each of said rotary snap-in connectors (15) has a head (16), said head (16) being inserted through each of said second slots (4*b*), said head then being snapped by twisting into each of said grooves (11) of said profile rods (10).

4. The device according to claim 3 wherein said head has a projection (16*b*), each of said grooves (11) has a contour, and said projection is snapped into said contour of said grooves (11).

5. The device according to claim 3 wherein said head has a front face and a projection (16*b*) is formed on said front face of said head (16).

* * * * *